US006174182B1

(12) United States Patent
Kuo

(10) Patent No.: US 6,174,182 B1
(45) Date of Patent: Jan. 16, 2001

(54) CABLE CONNECTOR

(75) Inventor: Peter Kuo, Chung-Ho (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/394,291

(22) Filed: Sep. 10, 1999

(30) Foreign Application Priority Data

Jun. 8, 1999 (TW) ..... 88209348

(51) Int. Cl.[7] ..... H01R 13/53

(52) U.S. Cl. ..... 439/181; 439/610; 439/95; 439/358; 439/939

(58) Field of Search ..... 439/610, 95, 358, 439/357, 181, 98, 939

(56) References Cited

U.S. PATENT DOCUMENTS

| | | | | |
|---|---|---|---|---|
| 5,611,708 | * | 3/1997 | Mizunuma et al. | 439/358 |
| 5,741,150 | * | 4/1998 | Stinson et al. | 439/358 |
| 5,785,555 | * | 7/1998 | O'Sullivan et al. | 439/610 |
| 5,788,528 | * | 8/1998 | Orr, Jr. et al. | 439/358 |
| 5,941,726 | * | 8/1999 | Koegel et al. | 439/358 |

* cited by examiner

*Primary Examiner*—Gary F. Paumen
(74) *Attorney, Agent, or Firm*—Wei Te Chung

(57) ABSTRACT

A cable connector in accordance with the present invention comprises a jacket consisting of upper and lower jacket members enclosing the cable connector, a dielectric housing retaining a plurality of terminals in a mating portion for electrically connecting with a mating connector, upper and lower shells for enclosing the housing, and a pair of latching members mounted to opposite sides of the cable connector. Each latching member comprises an elongate resilient bar for engaging with the lower shell, and a latching portion extending beyond the housing for engaging with a shield of a mating connector. A pair of touching tabs extends from opposite free ends of a peripheral wall of the lower shell for contacting the resilient bars of the corresponding latching members. Thus, the grounding wires of the cable, the touching tabs of the lower shell, the latching portions and the resilient bars of the latching members, the shield of the mating connector and a metallic panel to which the mating connector is fixed together form a grounding path therethrough, for discharging the static electricity accumulated on the cable connector, the mating connector, and the metallic panel when the latching members contact the shield of the mating connector.

4 Claims, 5 Drawing Sheets

CABLE CONNECTOR

BACKGROUND OF THE INVENTION

The present invention relates to a cable connector, and particularly to a cable connector that can promptly discharge static electricity accumulated on the cable connector and a mating connector when the cable connector engages with the mating connector.

As cable connectors become more dense and signal transmission speeds increase, shielding the connector from electronic magnetic interference and discharging static electricity become increasingly important to ensure proper signal transmission through the cable connector. Pertinent cable connectors are disclosed in U.S. Pat. No. 785,555; and Taiwan Patent Application Nos. 77204450, 77210069, 86102090, and 86102089.

Referring to FIGS. 1 and 2, a conventional cable connector 5 includes a grounding mechanism. The grounding mechanism comprises a pair of studs 51 fixed in a metallic shroud 7, one or more grounding plate 52 positioned in a mating opening 50 of a dielectric housing 56, and one or more grounding member 520 enclosing and abutting against a metallic braid 60 of a wire 6. The grounding plate 52 is fixed between two adjacent terminals 53 and is appropriately separated by partitions (not labeled) of the housing 56. Thus, the grounding plate 52 is sandwiched between the two wires 6 terminated to the adjacent terminals 53, while the grounding member 520 around the wires 6 electrically contact the grounding plate 52. Thus, when a mating connector (not shown) engages with the cable connector 5, static electricity accumulated on the mating connector, the cable connector 5 and the cable 6 is discharged along a grounding path formed through a metallic shell of the mating connector, the studs 51, the shroud 7, the grounding plate 52 and the grounding member 520. However, such a grounding mechanism is complex and the manufacturing process is time-consuming thereby increasing costs.

Another type of conventional cable connector comprises one or more shields terminating one or more grounding wires included in a cable with which the cable connector is connected. When a mating connector engages with the cable connector, a shell of the mating connector will electrically contact the shields of the cable connector. Thus, a grounding path is formed through the shell of the mating connector, the shield and the grounding wire of the cable for discharging static electricity accumulated on the cable connector, the cable and the mating connector. However, such a grounding path is usually quite simple thereby just performing a simple function which may not fulfil grounding requirements under high speed and high frequency conditions.

BRIEF SUMMARY OF THE INVENTION

A main object of the present invention is to provide a cable connector which promptly discharges static electricity accumulated on the cable connector and a mating connector when the cable connector engages with the mating connector.

Another object of the present invention is to provide a cable connector which can be manufactured at a low cost.

A cable connector, for terminating a cable containing one or more grounding a wire therein, in accordance with the present invention comprises a jacket consisting of upper and lower jacket members enclosing the cable connector, a dielectric housing retaining a plurality of terminals in a mating portion for electrically connecting with a mating connector, upper and lower shells for enclosing the housing, and a pair of latching members mounted to opposite sides of the cable connector.

The latching members are fixed between the jacket and the housing for securely engaging with a shield of the mating connector or a metallic panel to which the mating connector is fixed. Each latching member comprises an engaging portion for engaging with the upper and lower jackets, an elongate resilient bar for engaging with the lower shell, and at latching portion for engaging with the shield of the mating connector and the metallic panel. The lower shell has a bottom wall and a peripheral wall extending from a periphery of the bottom wall thereby defining a receiving space for receiving the housing therein. A pair of touching tabs extends from opposite free ends of the peripheral wall for contacting the resilient bars of the corresponding latching members. The latching portions of the latching members outwardly extend beyond the mating portion of the housing for engaging with the mating connector.

Thus, the grounding wires of the cable, the touching tabs of the lower shell, the latching portions and the resilient bars of the latching members, and the shield of the mating connector or the metallic panel together form a grounding path therethrough. The grounding path can discharge static electricity accumulated on the cable connector, the mating connector, and the metallic panel when the latching members contact the shield of the mating connector.

Other objects, advantages and novel features of the invention will become more apparent from the following detailed description when taken in conjunction with the accompanying drawings.

DETAILED DESCRIPTION OF THE INVENTION

Figure 1:
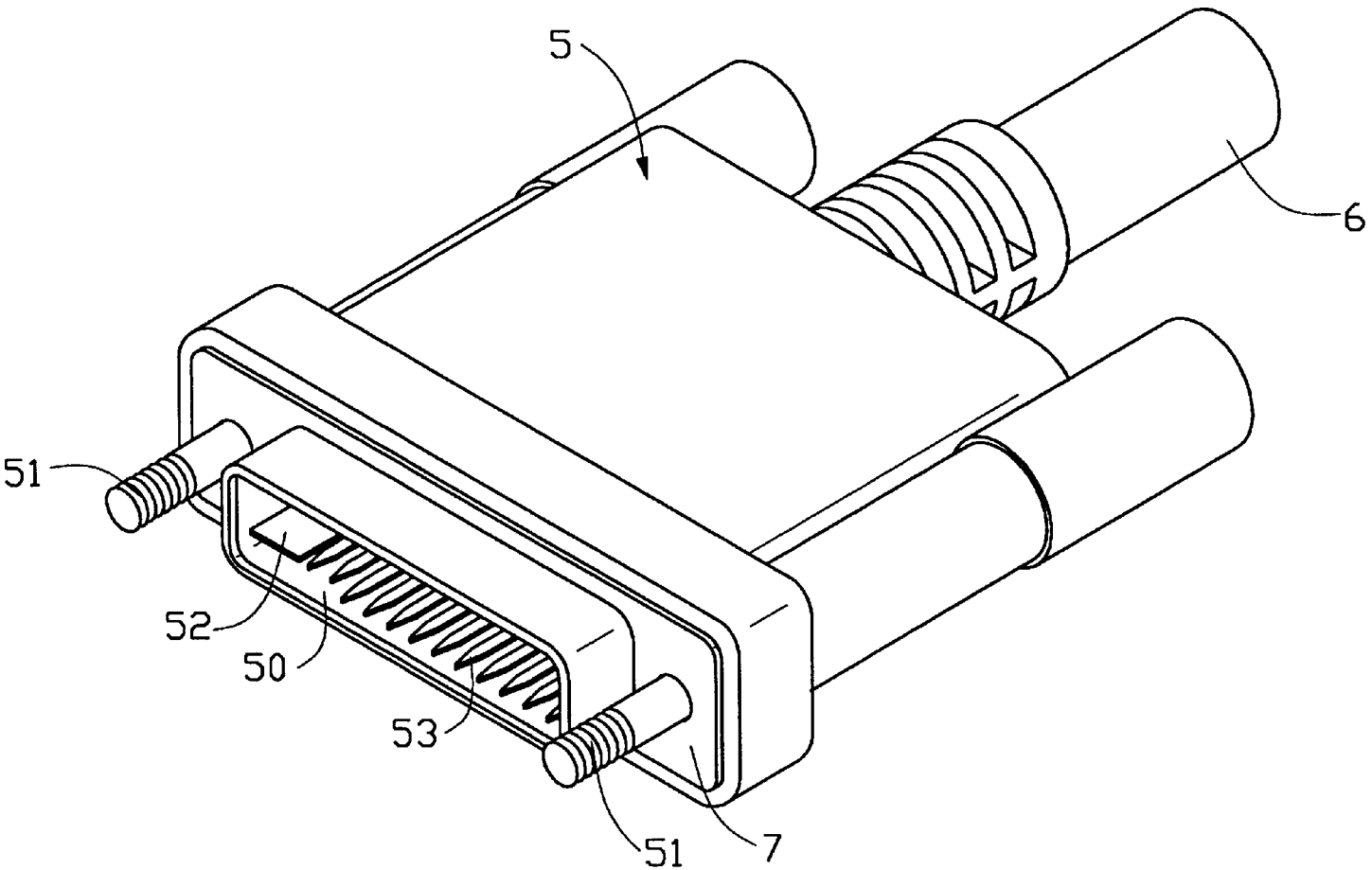
FIG. 1 (PRIOR ART)
FIG. 1 is a perspective view of a conventional cable connector.
Figure 2:
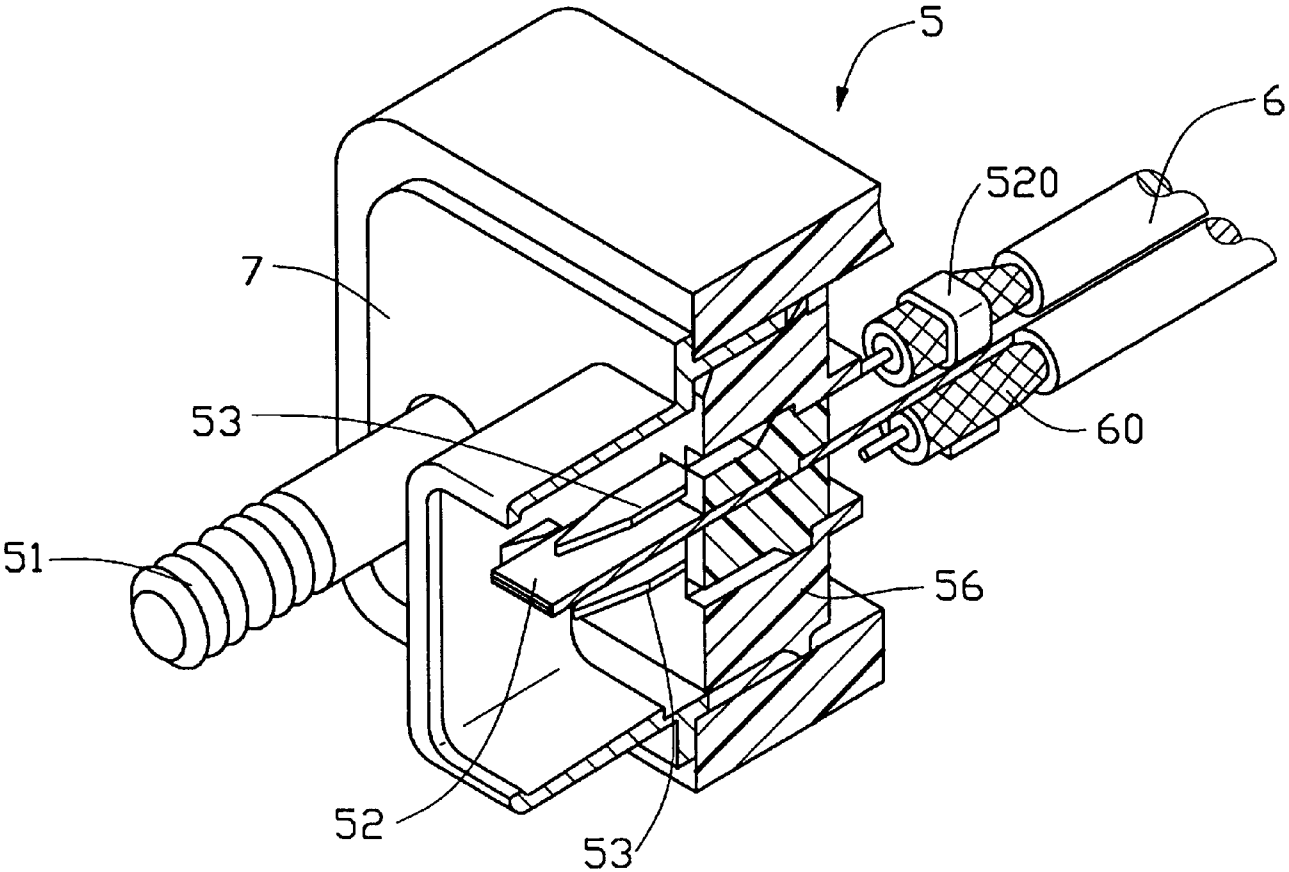
FIG. 2 (PRIOR ART)
FIG. 2 is a cross-sectional view of FIG. 1.
Figure 3:
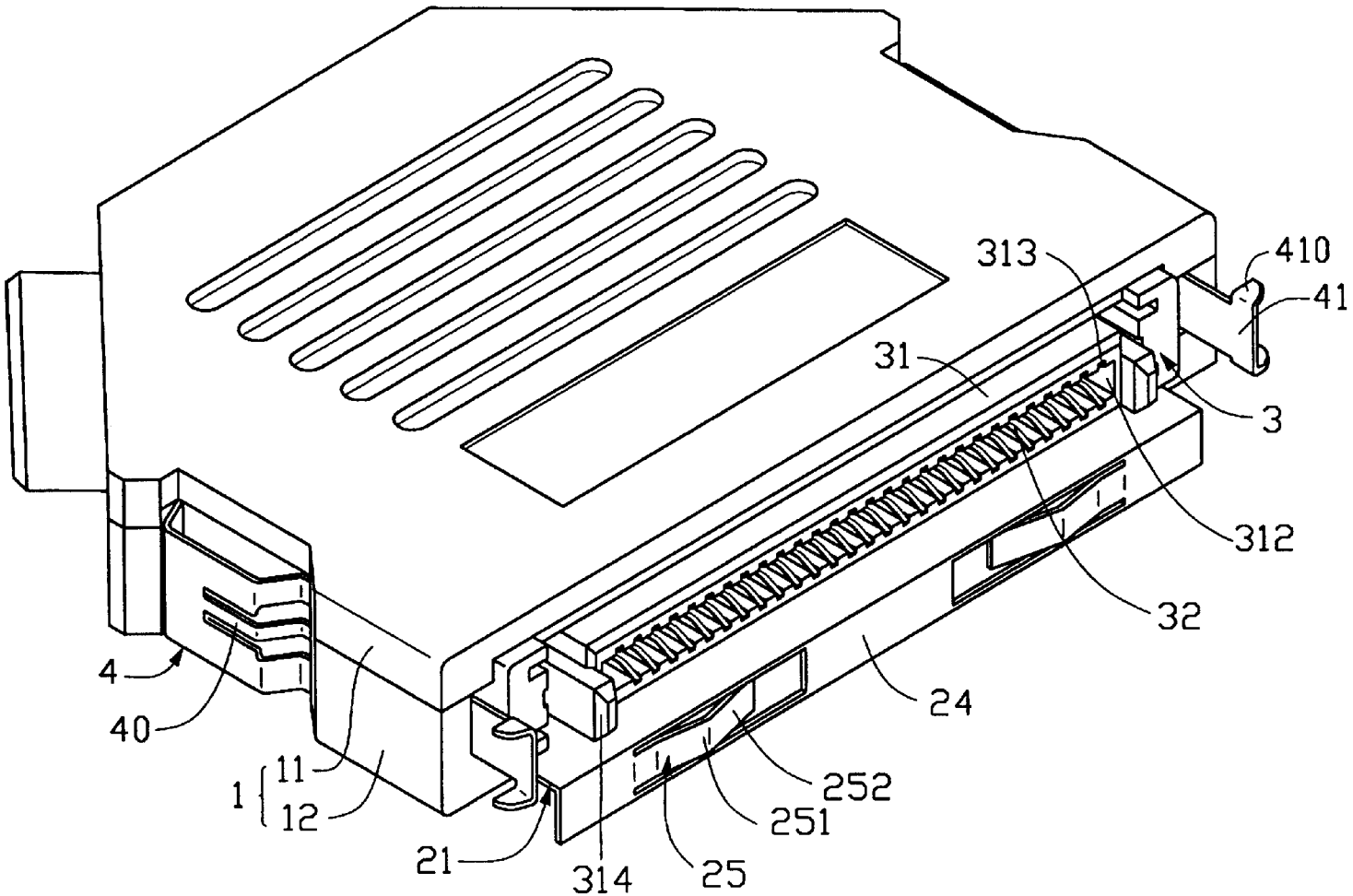
FIG. 3 is a perspective view of a cable connector in accordance with the present invention.

Referring to FIG. 3, a cable connector in accordance with the present invention comprises a jacket 1 consisting of upper and lower jacket members 11, 12 for enclosing the cable connector, a dielectric housing 3 retaining a plurality of terminals 32 in a mating portion 31, upper and lower shells 20, 21 (FIGS. 4 and 5), and a pair of latching members 4 fixed to opposite sides of the cable connector. The mating portion 31 of the housing 3 forms a mating opening 312 and a plurality of receiving passageways 313 in opposite upper and lower inner side walls of the mating portion 31 just within the mating opening 312 for receiving the corresponding terminals 32 therein. The housing 3 further forms a pair of guiding posts 314 for guiding the mating connector to enter into engagement with the cable connector.

Figure 5:
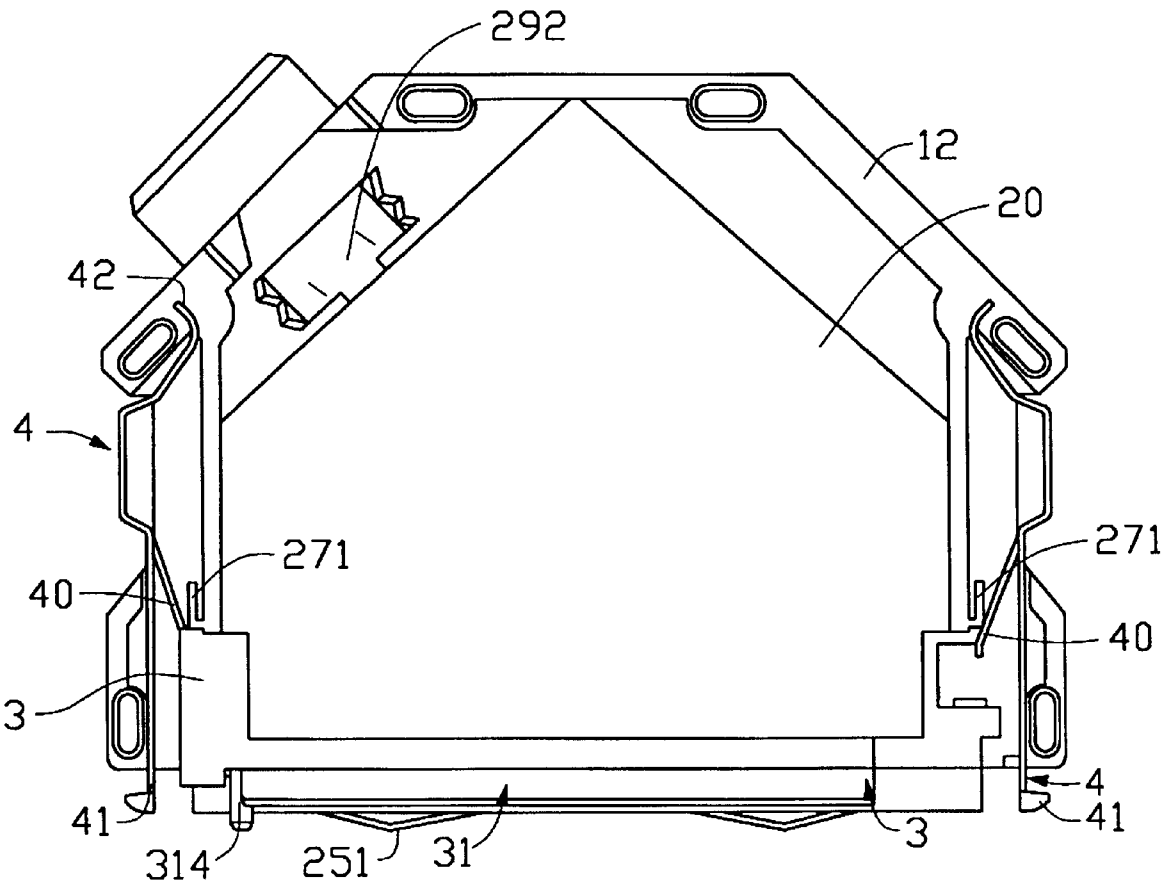
FIG. 5 is a top plan view of FIG. 3 with an upper jacket member removed for clearly showing the internal structure of the cable connector.

Referring also to FIG. 5, each latching member 4 comprises an engaging portion 42 for engaging with the lower jacket member 12, a latching portion 41 extending outward for latching a metal shell (not shown) of the mating connector, and a resilient bar 40 inwardly inclined for engaging with a corresponding touching tab 271 (which will be introduced below) of the lower shell 21. The latching portion 41 outwardly extends beyond the mating portion 31 of the housing 3 and forms a pair of hooks 410 for latching with the shield of the mating connector.

Figure 4:
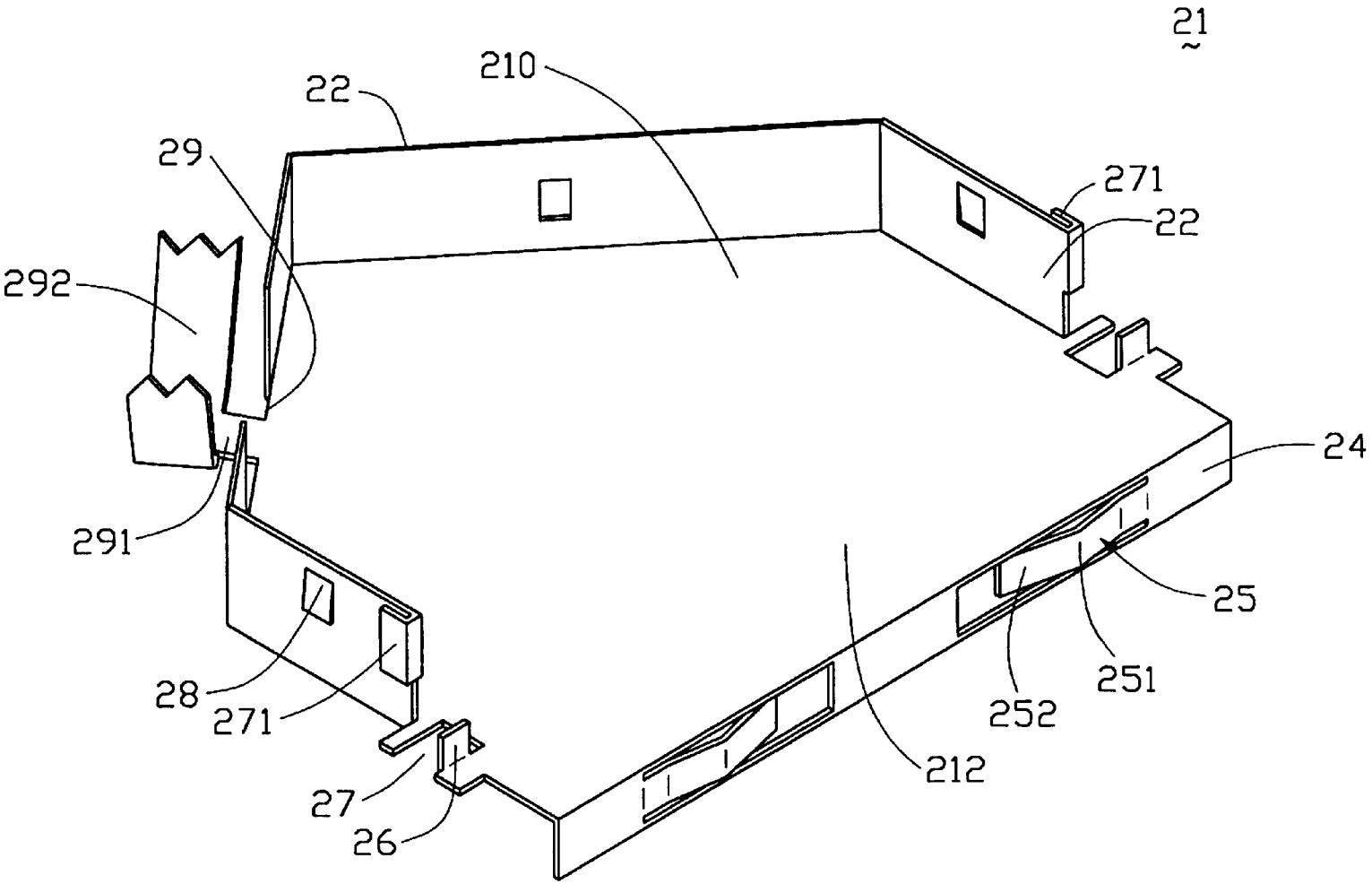
FIG. 4 is a perspective view of a lower shell of FIG. 3.

Referring to FIG. 4, the lower shell 21 forms a bottom wall 210 and a peripheral wall 22 upwardly extending from a periphery of the bottom wall 210 thereby defining a receiving space for receiving the housing 3 therein. An aperture 29 is defined in the peripheral wall 22, while a connecting neck 291 outwardly extends from an edge of the bottom wall 210 and through the aperture 29. A clasp 292 is formed on an end of the connecting neck 291 for clamping a cable (not shown) therein and for terminating one or more grounding wires contained in the cable. A plurality of latching tabs 28 outwardly extends from the peripheral wall 22 for engaging with the lower jacket member 12. A pair of cutouts 27 is defined in opposite lateral edges of the bottom wall 210 adjacent to the opposite ends of the peripheral wall 22 for engaging with the lower jacket member 12. A pair of engaging tabs 26 upwardly extends from the opposite lateral edges of the bottom wall 210 adjacent to the corresponding cutouts 27 for engaging with the lower jacket member 12.

A pair of the touching tabs 271 outwardly extends from opposite ends of the peripheral wall 22 and are appropriately curved for contacting the resilient members 40 of the corresponding latching members 4. Thus, the shield of the mating connector, the latching portions 41 of the latching members 4, the resilient members 40 of the latching members 4, the touching tabs 271 of the lower shell 21, the clasp 29 of the lower shell 21 and the grounding wire of the cable establish a grounding path therethrough. When the mating connector is moved toward the cable connector and the latching portions 41 of the latching members 4 contact the shield of the mating connector, the grounding path discharges static electricity accumulated on the cable, the cable connector and the mating connector before the cable connector engages with the mating connector.

In another preferable embodiment, the mating connector is fixed in a metallic panel (not shown) of a computer enclosure (not shown). The latching portions 41 of the latching members 4 are engageable with the metallic panel. Thus, the grounding path described above can also discharge static electricity accumulated on the cable, the cable connector, the mating connector and the metallic panel before the mating connector engages with the cable connector.

The lower shell 21 further comprises an outwardly extending grounding section 212 for discharging static electricity accumulated on the cable connector and the mating connector and the metallic panel. The grounding section 212 comprises a vertical plate 24 perpendicularly bent from the grounding section 212 and aligning with the mating portion 31 of the housing 3. A pair of V-shaped resilient members 25 is stamped from the vertical plate 24. Each resilient member 25 comprises a ridge 251 outwardly projecting beyond the vertical plate 24 and the mating portion 31 of the housing 3, and a free end 252. When the cable connector is moved to engage with the mating connector, the resilient members 25 will first contact the metallic panel before the cable connector engages with the mating connector. Thus, static electricity accumulated on the cable connector, the cable, the mating connector and the metallic panel can also be discharged through the metallic panel, the resilient members 25 of the lower shell 21, the clasp 292 of the lower shell 21 and the grounding wire of the cable.

Therefore, in this preferable embodiment, the cable connector establishes two different grounding paths to discharge static electricity accumulated on the cable, the cable connector, the mating connector and the metallic connector. Thus, the cable connector exhibits exceptional grounding capabilities.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector for interconnecting a cable with a mating connector having a metallic shield, comprising:

a dielectric housing having a mating portion retaining a plurality of terminals for terminating with the cable and for engaging with the mating connector;

a shell comprising a bottom wall, a clasp extending from the bottom wall for clasping the cable and for electrically linking with the cable, a peripheral wall upwardly extending from a periphery of the bottom wall thereby defining a receiving space for receiving the dielectric housing therein, a pair of touching tabs extending from opposite ends of the peripheral wall and being outwardly bent away from the peripheral wall; and a pair of metal latching members fixed with the dielectric housing, each latching member comprising an outwardly extending latching portion, for engaging with the metallic shield of the mating connector, and an inwardly inclined elongate resilient bar engaging with the shell;

wherein the touching tabs electrically contact the corresponding resilient bars of the latching members to form a grounding path through the metallic shield of the mating connector, the metal latching members, the shell and a grounding wire of the cable when the latching portions of the latching members contact the shield of the mating connector, thereby discharging static electricity accumulated on the mating connector, the cable connector and the cable before the cable connector engages with the mating connector;

wherein the touching tabs are appropriately bent for ensuring electrical contact with the resilient bars of the corresponding latching members;

wherein the shell further comprises a grounding section outwardly extending from the bottom wall, a vertical plate being perpendicularly bent from the grounding section and aligning with the mating portion of the dielectric housing, a pair of V-shaped resilient bars being stamped from the vertical plate and comprising a ridge for resiliently contacting a metallic panel to which the mating connector is fixed thereby forming a grounding path through the metallic panel, the resilient bars of the latching members, the clasp of the shill and the grounding wire of cable.

2. The cable connector as claimed in claim 1 further comprising a dielectric jacket for enclosing the dielectric housing and the shell.

3. The cable connector as claimed in claim 2, wherein each latching member comprises an engaging portion for engaging with the dielectric jacket.

4. The cable connector as claimed in claim 1, wherein an aperture is defined in the peripheral wall of the shell, the clasp extending through the aperture via a connecting neck.

* * * * *